US005162186A

United States Patent [19]

Sato

[11] Patent Number: 5,162,186

[45] Date of Patent: Nov. 10, 1992

[54] LASER-SENSITIVE ELECTROPHOTOGRAPHIC MATERIAL

[75] Inventor: Koji Sato, Kodaira, Japan

[73] Assignee: Oji Paper Co., Ltd., Tokyo, Japan

[21] Appl. No.: 618,548

[22] Filed: Nov. 27, 1990

[30] Foreign Application Priority Data

Nov. 28, 1989 [JP] Japan ..... 1-306409
Nov. 29, 1989 [JP] Japan ..... 1-307419

[51] Int. Cl.[5] ..... G03G 5/09
[52] U.S. Cl. ..... 430/92; 430/945
[58] Field of Search ..... 430/90, 91, 92

[56] References Cited

U.S. PATENT DOCUMENTS 4,929,527 5/1990 Kato et al. ..... 430/92
5,001,029 3/1991 Kato et al. ..... 430/96

*Primary Examiner*—John Goodrow
*Attorney, Agent, or Firm*—Armstrong & Kubovcik

[57] ABSTRACT

An electrophotographic material having an enhanced sensitivity to laser rays comprises, (A) an electroconductive, water-resistant substrate, and (B) a laser-sensitive electrophotographic layer comprising (a) a finely divided photoconductive zinc oxide, (b) a resinous binder, (c) a sensitizing dye comprising at least one member selected from the compounds of the formulae (I):

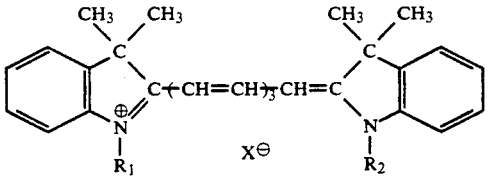

(I)

wherein $R_1$ and $R_2$ are respectively $—CH_3$, $—C_2H_5$ or $—CH_2—CH{=}CH_2$ radical and X is a halogen atom, and (d) a sensitizing assistant comprising at least one member selected from (a) aliphatic carboxylic anhydrides of the formula (II):

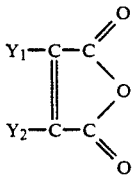

(II)

wherein $Y_1$ is a hydrogen or halogen atom and $Y_2$ is a halogen atom, and (b) aromatic carboxylic anhydride derived from aromatic carboxylic acids having at least three—COOH groups attached to a benzene ring.

7 Claims, No Drawings

LASER-SENSITIVE ELECTROPHOTOGRAPHIC MATERIAL

BACKGROUND OF THE INVENTION

1. Field of the Invention

The present invention relates to a laser-sensitive electrophotographic material. More particularly, the present invention relates to an electrophotographic material having an enhanced spectral sensitivity to semiconductor laser rays.

2. Description of the Related Art

Generally, a conventional zinc oxide-resin dispersion type electrophotographic material comprises an electroconductive substrate and a photosensitive layer formed on a surface of the substrate and comprising a principal component consisting of a finely divided photoconductive zinc oxide and an additional material consisting of a resinous binder and a sensitizing agent.

The zinc oxide contained in the photosensitive layer exhibits a photosensitivity only at a wave length of about 370 nm located in the ultraviolet band. Therefore, in the conventional electrophotographic material sensitive to visible light rays, the zinc oxide must be present in the photosensitive layer in combination with a sensitizing dye, to broaden the wave length range of light rays to which the photosensitive layer exhibits a satisfactory sensitivity.

Usually, the visible light rays generated from, for example, a halogen lamps, are used as a photographic light for the electrophotographic material. Due to the development of various recording machines such as laser printers and the spread of the digitalization of data, however, various laser rays, for example, argon laser rays, semiconductor laser rays, and helium-neon laser rays, are now widely used for the electrophotographic materials.

Among them, however, semiconductor laser rays, which have a large wave length of 700 to 1000 nm, are the most useful, since these semiconductor laser rays can be generated at a lower cost than that of other laser rays, and can be directly modulated and used in a smaller device than that needed for the other laser rays.

The conventional photosensitive layer containing the zinc oxide in combination with the sensitizing dye exhibits a very low or substantially no sensitivity to the semiconductor laser rays, and thus the conventional electrophotographic material is substantially useless when the semiconductor laser rays are used.

Various electrophotographic materials having an enhanced sensitivity to the semiconductor laser rays are disclosed in, for example, Japanese Unexamined Patent Publication Nos. 57-46245, 58-58554, 58-59453, 59-22053 and 59-78358.

In those electrophotographic materials, the finely divided zinc oxide is contained in combination with a sensitizing dye, for example, a polymethine type cyanine dye, to extend the spectral wave length range of the usable light rays to which the electrophotographic materials are sensitive, to the long wave length side.

Nevertheless, this type of conventional electrophotographic material, in which zinc oxide is contained in combination with only the sensitizing dye, has an unsatisfactory sensitivity to the semiconductor laser rays. Especially, in recording machines, for example, a laser printer, the scanning exposure is carried out at a high speed, and thus the conventional electrophotographic material containing the sensitizing dye is not satisfactory or practical for semiconductor laser ray exposure.

Some of the conventional electrophotographic materials sensitive to the semiconductor laser rays contain, in addition to the sensitizing dye, a sensitizing assistant consisting of an electron-affinitive compound.

For example, Japanese Unexamined Patent Publication No. 1-16253 discloses a combination of a sensitizing coloring material consisting of a polymethine type cyanine dye compound having two terminal dimethyl indol ring structures each having an alkylsulfone radical attached to the N-substituent in the ring structure, with a sensitizing assistant consisting of maleic anhydride.

The above-mentioned type of electrophotographic photosensitive material has a high sensitivity sufficient for use for laser printers and laser plate maker, in which the semiconductor laser rays are utilized, but this conventional laser-sensitive electrophotographic material is disadvantageous in that the dark decay is large and the high humidity environment is increased.

SUMMARY OF THE INVENTION

An object of the present invention is to provide a laser-sensitive electrophotographic material having an excellent sensitivity to long wave length rays having a wave length of from 700 to 1000 nm.

Another object of the present invention is to provide a laser-sensitive electrophotographic material having a high sensitivity to semiconductor laser rays.

Still another object of the present invention is to provide a laser-sensitive electrophotographic material in which the dark decay is small and is not changed, even if the environmental conditions are changed.

The inventors of the present invention found that the above-mentioned objects can be attained by utilizing a sensitizing dye comprising a specific polymethine cyanine dye compound, in combination with a sensitizing assistant comprising a specific cyclic carboxylic anhydride for the laser-sensitive electrophotographic layer in the laser-sensitive electrophotographic material.

Accordingly, the laser-sensitive electrophotographic material of the present invention comprises (A) an electroconductive, water-resistant substrate; and (B) a laser-sensitive electrophotographic layer formed on a surface of the substrate and comprising a finely divided photoconductive zinc oxide, a resinous binder, a sensitizing dye and a sensitizing assistant, the sensitizing dye comprising at least one compound of the formula (I):

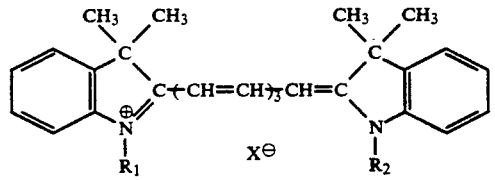

(I)

wherein $R_1$ and $R_2$ represents respectively and independently from each other, a member selected from the group consisting of $-CH_3$, $-C_2H_5$ and $-CH_2-CH=CH_2$ radicals, and X represents a halogen atom; the sensitizing assistant comprising at least one member selected from the group consisting of:

(a) aliphatic dicarboxylic anhydrides of the formula (II):

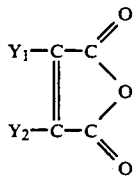

(II)

wherein $Y_1$ represents a member selected from the group consisting of a hydrogen atom and halogen atoms and $Y_2$ represents a halogen atom, and (b) aromatic cyclic multicarboxylic anhydrides derived from aromatic carboxylic acids having a benzene ring structure and at least three carboxylic (—COOH) groups attached to the benzene ring structure.

DESCRIPTION OF THE PREFERRED EMBODIMENTS

The laser-sensitive electrophotographic material of the present invention comprises (A)an electroconductive substrate and (B) a laser-sensitive electrophotographic layer formed on a surface of the substrate.

The electroconductive substrate usable for the present invention comprises a member selected from, for example, metal sheets; paper and plastic resin sheets each laminated with a metal foil, for example, aluminum foil; paper and plastic resin sheets each coated with a metallic material or a metal oxide material by a vacuum evaporation method; laminates of a paper sheet with a plastic resin film; electroconductive paper sheets; and composite sheets composed of two or more of the above-mentioned sheet materials.

The laser-sensitive electrophotographic layer comprises a finely divided photoconductive zinc oxide, a resinous binder, a specific sensitizing coloring material, and a specific sensitizing assistant.

The sensitizing dye usable for the electrophotographic layer of the present invention comprises at least one member selected from the specific polymethine cyanine compounds of the above-mentioned formula (I).

The sensitizing assistant usable for the present invention comprises at least one member selected from (a) the specific aliphatic dicarboxylic anhydrides of the above-mentioned formula (II), and (b) aromatic cyclic multicarboxylic anhydrides derived from aromatic multicarboxylic acids having a benzene ring structure and at least three carboxyl (—COOH) groups attached to the benzene ring structure.

The specific sensitizing dye usable for the present invention is advantageous in that it provides a very small dark decay and a high thermal stability of the resultant electrophotographic layer. When the sensitizing dye is used in combination with a conventional sensitizing assistant, for example, phthalic anhydride, the resultant electrophotographic layer exhibits an unsatisfactory sensitivity to laser rays. In the present invention, however, the combination of the specific polymethine cyanine compound with the specific aliphatic cyclic dicarboxylic anhydride surprisingly results in a greatly enhanced sensitivity of the resultant electrophotographic layer to semiconductor laser rays.

In the formula (I) for the polymethine cyanine compounds usable for the sensitizing dye of the present invention, $R_1$ and $R_2$ is, respectively and independently from each other, $—CH_3$, $—C_2H_5$ or $—CH_2—CH=CH_2$ and X is a hydrogen atom.

The sensitizing dye in the electrophotographic layer is preferably in an amount of from 0.001% to 0.5%, more preferably from 0.01% to 0.2%, based on the weight of the zinc oxide.

In the formula (II) for the aliphatic cyclic dicarboxylic anhydrides for the sensitizing assistant of the present invention, $Y_1$ is a hydrogen or hydrogen atom, and $Y_2$ is a halogen atom. Namely, the aliphatic cyclic dicarboxylic anhydrides (a) are preferably selected from monochloromaleic anhydride, dichloromaleic anhydride, and dibromomaleic anhydride.

The aromatic cyclic multicarboxylic anhydrides (b) usable for the sensitizing assistant of the present invention are preferably selected from trimellitic anhydride and pyromellitic anhydride.

Preferably, the sensitizing assistant in the electrophotosensitive layer is in an amount of 0.01% to 1%, more preferably 0.02% to 0.5%, based on the weight of the zinc oxide.

The zinc oxide usable for the electrophotographic layer of the present invention has a photoconductive property and is in the form of fine particles preferably having a particle size of from 0.1 to 0.5 μm.

The resinous binder usable for the electrophotographic layer of the present invention comprises at least one type of resinous binding material. The resinous binding materials usable for the present invention are not limited to special types, as long as they exhibit a satisfactory binding property. The resinous binder comprises at least one member selected from, for example, polyester resins, acrylic resins, epoxy resins, polycarbonate resins, melamineformaldehyde resins, butyral resins, silicone resins, polyurethane resins, polyamide resins, alkyl resins, polystyrene resins, polyvinyl butyral resins, xylene-formaldehyde resins, and phenoxy resins. The most preferable resinous materials for the resinous binder are oil soluble acrylic resins, for example, those available under the trademarks of LR-188 and LR-396, from Mitsubishi Rayon Co.

In the electrophotographic layer, the resinous binder is preferably in an amount of from 10% to 30%, more preferably from 15% to 25%, based on the weight of the zinc oxide.

The laser-sensitive electrophotographic material of the present invention can be produced in the following manner.

A coating paste is prepared by uniformly mixing predetermined amounts of finely divided zinc oxide, a sensitizing dye, a sensitizing assistant, a resinous binder and an organic medium comprising at least one member selected from, for example, toluene and 2-butanone, by a mix-dispersing machine, for example, a ball mill, sand grinder or paint shaker.

In the mixing procedure, all components may be admixed in a single step, but preferably, in the first step, the zinc oxide particles are mixed with the sensitizing assistant to absorb the sensitizing assistant on the surface thereof, and then the remaining components are admixed therewith. In the first step, the zinc oxide particles are dispersed in a solution of the sensitizing assistant in a solvent, and the sensitizing dye and the resinous binder are successively admixed to the dispersion after at least a portion of the solvent is removed by evaporation, or without evaporating the solvent, to provide a coating paste.

The resultant coating paste is applied to a surface of the electroconductive substrate and the layer of the coating paste is dried and solidified to form an electrophotographic layer.

The thickness of the electrophotographic layer influences the static charging property, and light sensitivity thereof, and thus is preferably from 5 to 25 μm, more preferably from 10 to 20 μm.

To form visible images on the electrophotographic material of the present invention, the electrophotographic layer thereof is first charged with static electricity using a corona charger, is then subjected to an imagewise scanning exposure to semiconductor laser rays, to form latent images on the electrophotographic layer, the latent images are developed with a toner, to form visible images, and the resultant visible images are then heat-fixed.

The resultant images can be used as recording images. Alternatively, the developed electrophotographic layer surface can be treated with an etching liquid containing an etching agent, for example, sodium ferrocyanide, to make the non-image portions hydrophilic, and the treated material can be used as a printing master sheet for an offset printing procedure.

EXAMPLES

The specific examples presented below will more fully elaborate on the ways in which the present invention can be practically used. It should be understood, however, that the examples are only illustrative and in no way limit the scope of the present invention.

In the examples, the part and % are by weight unless otherwise indicated.

EXAMPLE 1

A paste was prepared by mixing the following components, in the order as indicated below, in a rotation mixer.

| Component | Trademark | Part by weight |
|---|---|---|
| Toluene | — | 120 |
| Acrylic resin | LR-188 (Mitsubishi Rayon Co.) | 25 |
| Dichloromaleic anhydride | — | 0.2 |
| Zinc oxide | SAZEX #2000 (Sakai Kagaku K.K.) | 90 |

This paste was admixed with a solution of 0.02 part by weight of a sensitizing dye consisting of an aliphatic polymethine cyanine compound of the formula (I), wherein $R_1$ and $R_2$ are respectively a $—CH_3$ radical and X is an iodine (I) atom, in 3 parts by weight of methyl alcohol. The admixture was dispersed in a sand grinder to provide a coating paste for an electrophotographic layer.

An electroconductive substrate was prepared by laminating an electroconductive paper sheet having a basis weight of 80 g/m$^2$ with an aluminum foil having a thickness of 10 μm.

The aluminum foil layer surface of the substrate was coated with the above-mentioned coating paste and the coating paste layer was dried by hot air blowing at a temperature of 100° C. to provide an electrophotographic layer having a thickness of about 20 μm, and an electrophotographic sheet was obtained.

After the resultant electrophotographic sheet was moisture-conditioned in a darkroom at a temperature of 20° C. at a relative humidity of 65% RH for 24 hours, the electrophotographic layer surface of the electrophotographic sheet was charged with a negative corona charge, a spectral light having a wave length of 780 nm was radiated onto the charged surface of the electrophotographic sheet, and a relationship between the surface voltage of the electrophotographic layer surface and the radiating time was measured. From the measured surface voltage-radiating time course, a half-value exposure energy $E_{\frac{1}{2}}$ of the electrophotographic layer was calculated as a light sensitivity thereof.

Separately, after the negative corona discharge treatment, the treated electrophotographic sheet was left to stand in a darkroom for 60 seconds, and thereafter, the surface voltage of the electrophotographic layer was measured, and a ratio of this measured surface voltage to the initial surface voltage was calculated and indicated as the dark decay retention ratio. Thus, the higher the dark decay retention ratio, the smaller the dark decay.

The results of the above-mentioned tests are shown in Table 1.

The electrophotographic layer was charged with a negative corona charge at a voltage of −6V and the charged surface was subjected to a scanning exposure to a semiconductor laser ray having a wave length of 780 nm, stepwise at energy level of 2, 3, 4, 5 or 6 mW in accordance with a predetermined pattern.

The laser-exposed electrophotographic sheet was developed with a positive charged toner (made by ITEK).

The resultant developed electrophotographic sheet was fixed as a printing master sheet on a printing machine (trademark: 2800 CD, made by Ryobi K.K.) and the exposure latitude of the electrophotographic layer was measured in the following manner.

The exposure latitude was represented by the number of steps corresponding to the above-mentioned exposure energy levels from a step at which white fine lines in the back portions disappear to a step at which the black fine lines in the white portions are interrupted due to over-exposure. The larger the number of steps, the wider the latitude of the electrophotographic sheet to an exposure.

These test results are also shown in Table 1.

Furthermore, the electrophotographic sheet was left to stand in a low humidity atmosphere at a temperature of 20° C. and at a relative humidity of 30% RH for 12 hours, and then the conditioned sheet was subjected to the tests for the light sensitivity and the dark decay, to evaluate the environmental performance and thermal stability of the electrophotographic sheet.

The same test as mentioned above was carried out, except that the conditioning was carried out in a high humidity atmosphere at a temperature of 30° C. at a relative humidity of 85% RH.

Further, the same test was again carried out, except that the conditioning was carried out in a high temperature atmosphere of 80° C.

The results of these tests are shown in Table 2.

EXAMPLE 2

The same procedures as in Example 1 were carried out, except that the sensitizing assistance consisted of dibromomaleic anhydride in an amount of 0.3 part by weight.

The test results are shown in Tables 1 and 2.

EXAMPLE 3

The same procedures as in Example 1 were carried out, except that the sensitizing assistant consisted of monochloromaleic anhydride in an amount of 0.16 part by weight.

The test results are shown in Tables 1 and 2.

EXAMPLE 4

The same procedures as in Example 1 were carried out, except that the sensitizing dye consisted of the compound of the formula (I) in which $R_1$ and $R_2$ respectively represent a $—CH_2—CH=CH_2$ radical and X represents an iodine atom.

The test results are indicated in Tables 1 and 2.

COMPARATIVE EXAMPLE 1

The same procedures as in Example 1 were carried out, except that the sensitizing coloring material consisted of a compound of the formula:

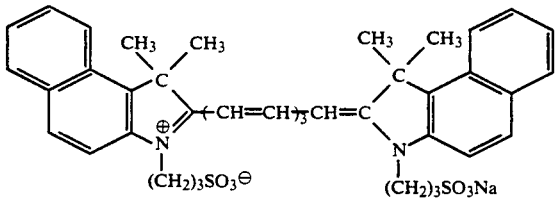

The test results are shown in Tables 1 and 2.

COMPARATIVE EXAMPLE 2

The same procedures as in Example 1 were carried out, except that the sensitizing assistant consisted of maleic anhydride.

The test results are shown in Tables 1 and 2.

COMPARATIVE EXAMPLE 3

The same procedures as in Example 1 were carried out, except that the sensitizing assistant consisted of phthalic anhydride.

The test results are shown in Tables 1 and 2.

TABLE 1

| Example No. | | Item: Half value of exposure $E_{\frac{1}{2}}$ (erg/cm$^2$) | Dark decay retention ratio (%) | Exposure latitude (number of steps) |
|---|---|---|---|---|
| Example | 1 | 75 | 88 | 2 |
| | 2 | 78 | 85 | 2 |
| | 3 | 80 | 80 | 2 |
| | 4 | 89 | 82 | 2 |
| Comparative Example | 1 | 75 | 65 | 0 |
| | 2 | 138 | 83 | 2 |
| | 3 | 160 | 82 | 2 |

TABLE 2

| Example No. | | Item: Conditioning (12 hours) 20° C., 30% RH $E_{\frac{1}{2}}$*1 (erg/cm$^2$) | DRR*2 (%) | 30° C., 85% RH $E_{\frac{1}{2}}$*1 (erg/cm$^2$) | DRR*2 (%) | 80° C. $E_{\frac{1}{2}}$*1 (erg/cm$^2$) | DRR*2 (%) |
|---|---|---|---|---|---|---|---|
| Example | 1 | 73 | 88 | 78 | 80 | 75 | 86 |
| | 2 | 79 | 86 | 80 | 82 | 82 | 87 |
| | 3 | 83 | 82 | 85 | 79 | 82 | 80 |
| | 4 | 87 | 85 | 92 | 78 | 95 | 82 |

TABLE 2-continued

| Example No. | | Item: Conditioning (12 hours) 20° C., 30% RH $E_{\frac{1}{2}}$*1 (erg/cm$^2$) | DRR*2 (%) | 30° C., 85% RH $E_{\frac{1}{2}}$*1 (erg/cm$^2$) | DRR*2 (%) | 80° C. $E_{\frac{1}{2}}$*1 (erg/cm$^2$) | DRR*2 (%) |
|---|---|---|---|---|---|---|---|
| Comparative Example | 1 | 102 | 63 | 77 | 25 | 80 | 55 |
| | 2 | 130 | 86 | 145 | 75 | 140 | 85 |
| | 3 | 165 | 85 | 170 | 76 | 158 | 82 |

Note:
*1$E_{\frac{1}{2}}$: Half value of exposure (sensitivity, erg/cm$^2$)
*2DRR: Dark decay retention ratio (%)

EXAMPLE 5

The same procedures as in Example 1 were carried out, except that the sensitizing assistant consisted of pyromellitic anhydride in an amount of 0.12 part by weight.

The test results are shown in Table 3 and 4.

EXAMPLE 6

The same procedures as in Example 5 were carried out, except that the sensitizing assistant consisted of trimellitic anhydride in an amount of 0.11 parts by weight.

The test results are shown in Tables 3 and 4.

EXAMPLE 7

The same procedures as in Example 5 were carried out, except that the sensitizing dye consisted of a compound of the formula (I) wherein $R_1$ and $R_2$ are respectively a $—CH_2—CH=CH_2$ radical and X represents an iodine atom.

The test results are shown in Tables 3 and 4.

COMPARATIVE EXAMPLE 4

The same procedures as in Example 5 were carried out, except that the sensitizing dye consisted of the same compound as mentioned in Comparative Example 1.

The test results are indicated in Tables 3 and 4.

COMPARATIVE EXAMPLE 5

The same procedures as in Example 5 were carried out, except that the sensitizing assistant consisted of maleic anhydride.

The test results are shown in Tables 3 and 4.

COMPARATIVE EXAMPLE 6

The same procedures as in Example 5 were carried out, except that the sensitizing assistant consisted of phthalic anhydride.

The test results are shown in Tables 3 and 4.

TABLE 3

| Example No. | | Item: Half value of exposure $E_{\frac{1}{2}}$ (erg/cm$^2$) | Dark decay retention ratio (%) | Exposure latitude (step number) |
|---|---|---|---|---|
| Example | 5 | 80 | 80 | 3 |
| | 6 | 82 | 79 | 3 |
| | 7 | 85 | 78 | 2 |
| Comparative Example | 4 | 75 | 65 | 0 |
| | 5 | 138 | 83 | 3 |
| | 6 | 160 | 82 | 3 |

TABLE 4

| Example No. | | Item Conditioning (12 hours) 20° C., 30% RH $E_{\frac{1}{2}}$ (erg/cm$^2$) | DRR (%) | 30° C., 85% RH $E_{\frac{1}{2}}$ (erg/cm$^2$) | DRR (%) | 80° C. $E_{\frac{1}{2}}$ (erg/cm$^2$) | DRR (%) |
|---|---|---|---|---|---|---|---|
| Example | 5 | 78 | 82 | 82 | 78 | 80 | 80 |
| | 6 | 78 | 80 | 85 | 75 | 83 | 78 |
| | 7 | 80 | 80 | 87 | 75 | 85 | 75 |
| Comparative Example | 4 | 102 | 63 | 77 | 25 | 80 | 55 |
| | 5 | 130 | 86 | 145 | 75 | 140 | 85 |
| | 6 | 165 | 85 | 170 | 76 | 158 | 82 |

As Tables 1 to 4 clearly indicate, the electrophotographic layers of Example 1 to 7 in accordance with the present invention had a high sensitivity ($E_{\frac{1}{2}}$), a small drop in electric resistance in a darkroom, and a satisfactorily wide exposure latitude to semiconductor laser rays.

In Comparative Examples 1 to 6, however, the resultant electrophotoconductive layers were unsatisfactory in at least one item of the $E_{\frac{1}{2}}$, the dark decay retention ratio, and the exposure latitude thereof.

Also, it was confirmed that the electrophotographic layers of the present invention exhibited a very small change in the dark decay retention thereof and a comparatively small change in sensitivity, even when the environment has a high humidity, low humidity or a high temperature.

I claim:

1. A laser-sensitive electrophotographic material comprising:

(A) an electroconductive, water-resistant substrate; and (B) a laser-sensitive electrophotographic layer formed on a surface of the substrate and comprising a finely divided photoconductive zinc oxide, a resinous binder, a sensitizing dye and a sensitizing assistant, said sensitizing dye comprising at least one compound of the formula (I):

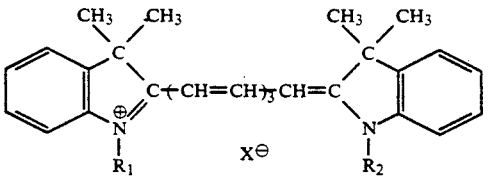

(I)

wherein $R_1$ and $R_2$ represents respectively and independently from each other, a member selected from the group consisting of $-CH_3$, $-C_2H_5$ and $-CH_2-CH=CH_2$ radicals, and X represents a halogen atom, and said sensitizing assistant comprising at least one member selected from the group consisting of:

(a) aliphatic dicarboxylic anhydrides of the formula (II):

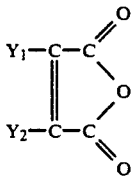

(II)

wherein $Y_1$ represents a member selected from the group consisting of a hydrogen atom and halogen atoms and $Y_2$ represents a halogen atom, and (b) aromatic cyclic multi-carboxylic anhydrides derived from aromatic carboxylic acids having a benzene ring structure and at least three carboxyl (—COOH) groups attached to the benzene ring structure.

2. The electrophotographic material as claimed in claim 1, wherein the sensitizing dye in the electrophotographic layer is in an amount of 0.001% to 0.5% based on the weight of the zinc oxide.

3. The electrophotographic material as claimed in claim 1, wherein the sensitizing assistant in the electrophotographic layer is in an amount of 0.01 to 1% based on the weight of the zinc oxide.

4. The electrophotographic material as claimed in claim 1, wherein the resinous binder in the electrophotographic layer is in a dry solid amount of 10% to 30% based on the weight of the zinc oxide.

5. The electrophotographic material as claimed in claim 1, wherein the electrophotographic layer has a thickness of from 5 to 20 μm.

6. The electrophotographic material as claimed in claim 1, wherein the aliphatic carboxylic anhydrides (a) of the formula (II) are selected from the group consisting of monochloromaleic anhydride, dichloromaleic anhydride, and dibromomaleic anhydride.

7. The electrophotographic material as claimed in claim 1, wherein the aromatic cyclic multicarboxylic anhydrides (b) are selected from the group consisting of trimellitic anhydride and pyromellitic anhydride.

* * * * *